US005789144A

United States Patent [19]

Thomas

[11] Patent Number: 5,789,144

[45] Date of Patent: Aug. 4, 1998

[54] METHOD FOR DEVELOPING A PHOTOGRAPHIC PRODUCT WITH INCORPORATED DEVELOPER

[75] Inventor: Francoise Marie Thomas, Chalon Sur Saone, France

[73] Assignee: Eastman Kodak Company, Rochester, N.Y.

[21] Appl. No.: 844,293

[22] Filed: Apr. 18, 1997

[30] Foreign Application Priority Data

Apr. 19, 1996 [FR] France ..... 96 05192

[51] Int. Cl.[6] ..... G03C 5/26

[52] U.S. Cl. ..... 430/449; 430/404; 430/405; 430/448

[58] Field of Search ..... 430/449

[56] References Cited

U.S. PATENT DOCUMENTS

| | | | |
|---|---|---|---|
| 2,648,604 | 8/1953 | Welliver et al. . | |
| 3,212,899 | 10/1965 | Kennard et al. . | |
| 3,615,521 | 10/1971 | Oftedahl . | |
| 3,628,955 | 12/1971 | Haist et al. . | |
| 3,649,265 | 3/1972 | Stewart . | |
| 3,713,827 | 1/1973 | Willems et al. . | |
| 3,847,618 | 11/1974 | Hofman et al. . | |
| 3,893,862 | 7/1975 | Munshi et al. . | |
| 4,632,896 | 12/1986 | Tsubai et al. . | |
| 5,009,984 | 4/1991 | De Rycke et al. | 430/404 |
| 5,387,483 | 2/1995 | Takagi | 430/204 |
| 5,432,042 | 7/1995 | Deprez et al. | 430/204 |

FOREIGN PATENT DOCUMENTS

| | | |
|---|---|---|
| 0 281 179 B1 | 11/1991 | European Pat. Off. . |
| 0 503 164 A1 | 9/1992 | European Pat. Off. . |
| 0 517 245 A1 | 12/1992 | European Pat. Off. . |
| 618 491 A1 | 3/1993 | European Pat. Off. . |
| 0 627 665 A1 | 12/1994 | European Pat. Off. . |
| 0 628 877 A1 | 12/1994 | European Pat. Off. . |
| 2472211 | 6/1981 | France . |
| 1121277 | 7/1968 | United Kingdom . |
| 1 292 027 | 10/1972 | United Kingdom . |

*Primary Examiner*—Hoa Van Le
*Attorney, Agent, or Firm*—J. Lanny Tucker

[57] ABSTRACT

The present invention concerns a method for developing a photographic product containing incorporated developers, and a layer of a novel activator. This method consists of applying to an exposed photographic product a thin layer of an aqueous homogeneous development activator solution which comprises (a) an alkanolamine in an amount higher or equal to 0.6 mol/l, (b) at least one stable wetting agent that is stable at a high pH and is miscible in the activator solution, and (c) a quaternary ammonium salt.

14 Claims, 5 Drawing Sheets

METHOD FOR DEVELOPING A PHOTOGRAPHIC PRODUCT WITH INCORPORATED DEVELOPER

FIELD OF THE INVENTION

The present invention concerns a method for developing a photographic product with incorporated developers, and a novel activator solution providing an improved efficiency in surface application processing.

BACKGROUND OF THE INVENTION

To develop black and white photographic products, the exposed product is normally processed with a developer that comprises at least one silver halide developer, for example hydroquinone or hydroquinone derivatives. Conventionally, the exposed product is immersed in a developing bath, and is then immersed in a fixing bath, then in a washing bath. Over time, the active components in the developing bath are depleted and it thus becomes less efficacious, requiring the use of a replenisher for renewing the developer.

This conventional technique requires large quantities of water to be used. Furthermore, the destruction or recycling of these large volumes of solution leads to numerous problems, in particular from the ecological point of view. This problem is all the more significant as standards for disposing of chemical solutions are becoming more and more severe.

In order to reduce the problems related to the use of these conventional developing baths, the developing agents (or developer) have been incorporated into one of the layers of the photographic product. Following imagewise exposure, these products with incorporated developers are developed with a basic solution, called an "activator". In general, the exposed photographic product is placed in contact with the activator by means of immersion in a tank containing the activator.

Other known methods consist of placing the photographic product to be developed in contact with a support, generally gelatin, impregnated with activator.

FR 2 003 178 and FR 2 414 743 describe photographic products with incorporated developers. In these products, a visible image is formed by placing the exposed photographic product in contact with a basic aqueous solution containing an alkaline metal hydroxide (sodium hydroxide, potassium hydroxide).

In FR 2 003 178, the activator and photographic product are placed in contact with each other by means of soaking, spraying or any suitable surface application means.

In FR 2 414 743, the exposed photographic product is developed by applying to the product a sheet comprising a support covered with a layer of gelatin impregnated with activator. The sensitometric curve obtained with this technique shows that, although development by such a technique is possible, the sensitometric results are significantly inferior to those obtained by soaking the photographic product in a tank containing the activator.

U.S. Pat. No. 3,847,618 describes a method for obtaining high-contrast images that consists of processing a photographic product with incorporated developers by means of a basic activator in the presence of hydroxylamine or an N-monosubstituted hydroxylamine derivative. In all examples, the photographic products are developed conventionally by immersion in a bath of activator.

EP 281 179 describes a development method that consists of developing a photographic product having incorporated developers and a pure chloride emulsion by contacting it with an aqueous alkaline solution that contains a primary and/or secondary amine. The contact between the photographic product with incorporated developers and the activator is generally achieved by immersion.

In order to limit the problems related to the use of a large volume of solution, it would be advantageous to have a method for developing a photographic product with incorporated developers by surface application of the alkaline activator.

The technique of development by impregnation considerably limits the volume of processing solution used in development, and consequently all the problems of recovery, recycling or destruction. However, these techniques require complex additional processing steps, such as, for example, the conditioning of the activator on a layer of gelatin. Moreover, this technique has not given satisfactory sensitometric results.

SUMMARY OF THE INVENTION

The present invention concerns a method for developing an exposed photographic product comprising a layer of incorporated developer, the photographic product also comprising a thin layer of an activator applied from the activator solution described below.

The present invention also provides a development activator solution comprising an alkanolamine in an amount higher than or equal to 0.6 mol/l, at least one wetting agent that is miscible in the activator solution and has a high pH stability, and a quaternary ammonium salt.

This invention enables photographic products to be developed rapidly with a very low volume of activator. In particular, it enables high-contrast photographic products to be processed, for example photographic products for graphic arts. According to the invention, it is possible to develop photographic products exposed with a volume of activator of between 20 and 200 ml/m$^2$ and preferably between 20 and 50 ml/m$^2$ of photographic product to be developed.

In conventional rack-and-tank development methods, the same developing bath is used to process a large number of photographic products. The chemical composition of this bath alters over time, leading to sensitometric variations between photographic products processed with a new bath and a seasoned bath. In the prior art, this drawback can be eliminated by using replenishing solutions.

The present invention eliminates sensitometric variations due to the use of seasoned baths. This is because the present invention enables photographic products to be developed with an activator that is never seasoned since the activator, applied in a thin layer, is used only once. Furthermore, by virtue of the application of the activator in a thin layer, the problems of recycling and destroying photographic effluents, and the problems related to the stirring of development baths, are eliminated.

This method reduces the ecological impact of development baths by virtue of the low volume of activator that is used. It also reduces the quantities of chemical product used.

DETAILED DESCRIPTION OF THE INVENTION

The present invention is a method for developing by application on the surface of an exposed photographic product, that is to say the photographic product is not immersed in a tank filled with activator, but its face opposite the support is covered with a thin layer of development activator.

The development activator can be applied in a thin layer by any known means, enabling an aqueous solution to be applied uniformly on a support so as to form a thin layer. This application can be carried out manually or automatically.

According to a preferred embodiment, the activator solution of the present invention comprises: (a) an alkanolamine in an amount higher than or equal to 0.6 mol/l, (b) 0.1 to 20 g/l of a quaternary ammonium salt, and (c) 0.1 to 3% by volume of activator solution of at least one wetting agent that is miscible in the activator solution and has a high pH stability.

Figures 1, 1A:
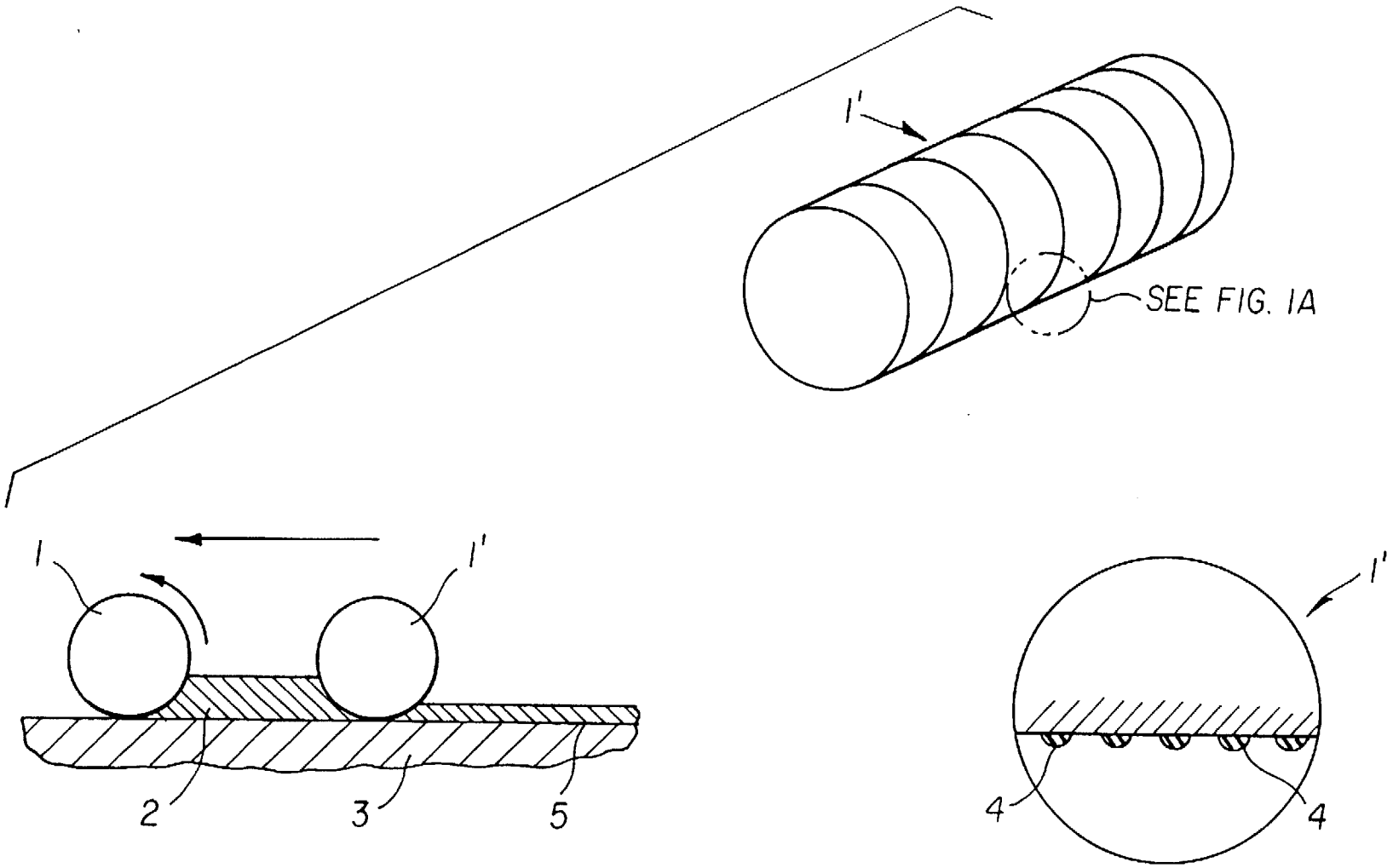
FIGS. 1 and 2 are diagrammatic depictions of a device for surface application of the activator.

According to one embodiment, the activator solution is applied by means of the device described in FIG. 1, which comprises 2 rollers (1, 1') connected together and forming a reservoir containing the activator solution to be spread (2), the assembly being placed on the surface of the film (3) to be developed. The front roller (1) is covered with a flexible rubber, the back roller (1') is a roller with a ribbed surface (4) enabling the spreading of the thin layer of activator (5) to be controlled. The device is equipped with means of automatically moving the device over the film, which enables a thin, uniform layer of activator to be deposited on the film (not visible in the figure).

Figure 2:
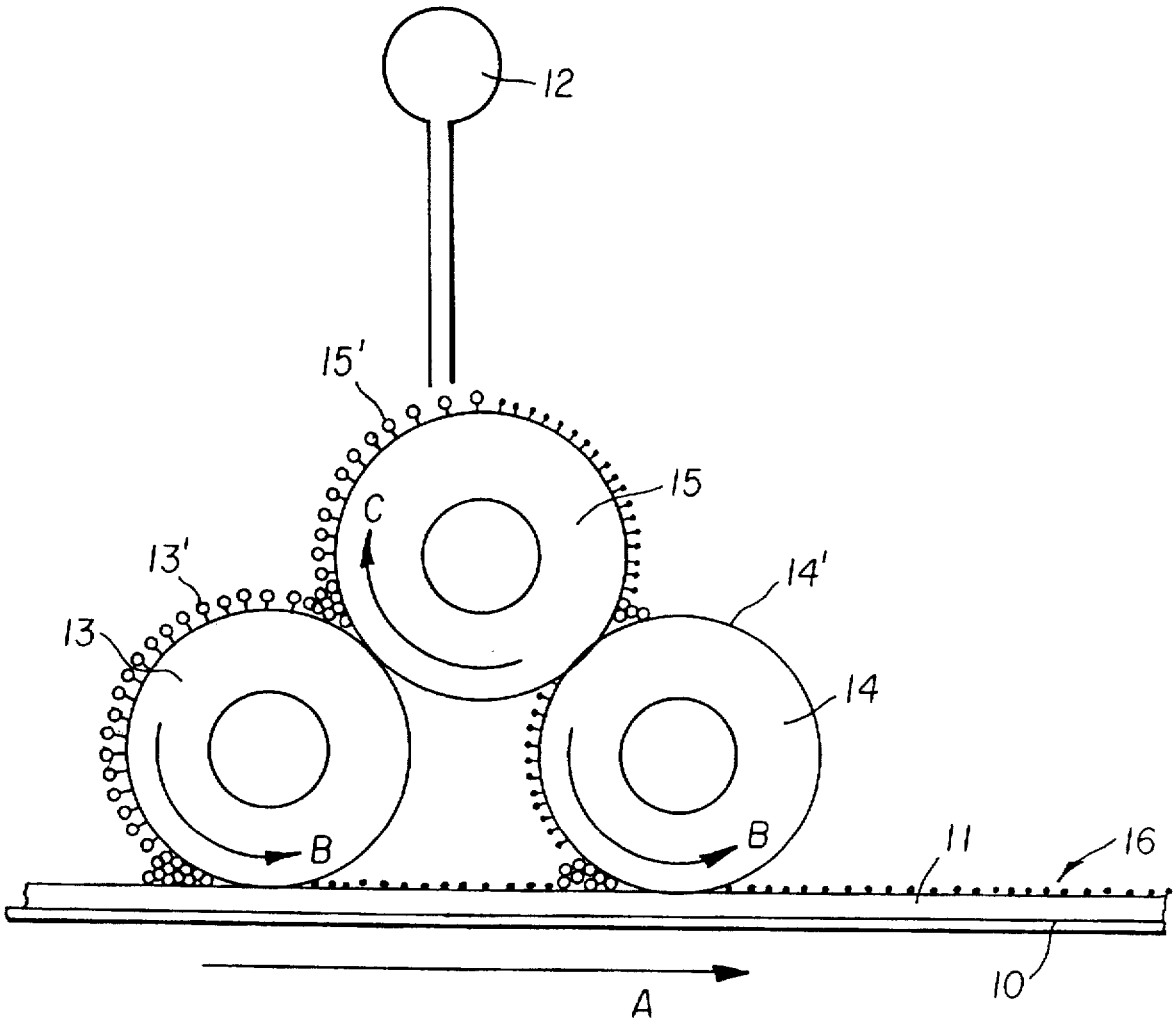

According to another embodiment, the activator is applied by means of the device described in the patent application GB 9519709.1 filed on 27 Sep. 1995 in the name of Kodak Ltd. This device, described in FIG. 2, comprises a plane (10) supporting the photographic product to be developed (11), a means of transporting the photographic product which does not appear in FIG. 2, a reservoir (12) which delivers a given quantity of activator solution, a means of applying the activator solution which comprises at least two lower rollers (13, 14) in contact with the photographic product to be developed, and a top roller (15) situated above each of the two lower rollers (13, 14), the top roller (15) being in contact with the lower rollers (13, 14). The activator solution is deposited on the surface of the roller (15') and then flows onto the surface of the lower rollers (13', 14'). When the photographic product is moved in the direction of the arrow (A), the lower rollers (13, 14) are rotated as indicated by the arrows (B, C), which leads to the rotation of the upper roller (15). This rotation deposits a thin layer (16) of activator solution on the film to be developed, as FIG. 2 shows.

The photographic product contains incorporated developers. It is possible to incorporate the developer into any layer of the photographic product; however, it is preferable not to incorporate the developer into the silver halide emulsion layer in order to avoid side effect reactions between this developer and the silver halides, before or after exposure. According to a preferred embodiment, the developer is incorporated into a layer adjacent to the silver halide emulsion layer. Preferably, this layer is situated between the support and the silver halide emulsion layer.

The developers that can be used are conventional developers used singly or in a mixture, for example aminophenols, polyhydroxybenzenes, such as paradihydroxybenzenes, for example hydroquinone or derivatives of hydroquinone, 3-pyrazolidones, pyrogallol, pyrocatechol, ascorbic acid, etc.

According to one embodiment, the developer is hydroquinone and/or a derivative of hydroquinone, for example tert-butylhydroquinone, methylhydroquinone, hydroquinone monosulfonate, etc.

The quantity of developer that is incorporated into the photographic product depends on the silver content of the light-sensitive layer of silver halide emulsion. The developer/Ag molar ratio is generally above 1/4. According to one embodiment, it is between 1/4 and 1/2.

It is often useful in systems with incorporated developers to use a co-developer that, in association with the developer, produces a synergy effect on the development. The quantity of this co-developer is, in general, much lower than the quantity of the main developer. The weight ratio of the developer to the co-developer is generally between 20/1 and 3/1, and preferably 10/1 and 5/1.

The most frequently used co-developers are 3-pyrazolidinone compounds, for example alkyl-3-pyrazolidinones, aryl-3-pyrazolidinones, for example 1-aryl-3-pyrazolidinones, 1-phenyl-3-pyrazolidinone (known under the name of phenidone), substituted phenidones, 4-methyl-4-hydroxymethyl phenidone, 1-phenyl-4-methyl pyrazolidinone and 1-phenyl-5-methyl-3-pyrazolidinone. The most commonly used co-developers are Dimezone S®, phenidone® and Elon®.

According to one embodiment of the invention, the alkanolamine is a primary, secondary or tertiary amine comprising a linear or branched hydroxyalkyl group comprising between 1 and 10 carbon atoms. The alkanolamine can be chosen from monoethanolamine, diethanolamine, 2-alkylethanolamines, 2-methylethanolamine, 2-ethylethanolamine, diethyl-N-N-aminoethanol, 3-aminopropanol, 2-amino-1-propanol, 4-amino-1-butanol, 2-amino-1-butanol, 3-diethyl-1-amino-1-propanol, 1-dimethylamino-2-propanol, 2-dimethylaminoethanol, N-ethyldiethanolamine, N-phenyldiethanolamine, triethanolamine, etc. These alkanolamines can be used in a mixture.

According to the invention, the alkanolamine concentration is from 0.6 to 2.0 mol/l, preferably 0.8 to 1.5 mol/l. The activator solution of the present invention is a highly alkaline homogeneous aqueous solution. The pH of the activator should be higher than 10. The alkanolamine being a buffer compound (pH around 12), a pH of the activator solution higher than 12 can only be obtained when large amount of alkanolamine is used. When an activator solution having a pH higher than 12 is contemplated, instead of introducing into the activator a large amount of alkanolamine, a strong base is preferably added to the activator solution containing at least 0.6 mol/l to adjust the pH value (for example KOH). For ecological and sensitometric reasons, it is however preferred an activator solution having a pH not higher than 13.

According to the present invention, the activator solution comprises at least one wetting agent that forms, with the activator, a stable and homogeneous solution. In the scope of the present invention, wetting agent refers to a surfactant that facilitates the spreading of the activator over the film and which assists chemical exchanges between the activator and the photographic product to be processed. This wetting agent facilitates the penetration and diffusion of the chemical species of the activator to the layer containing the developer.

This agent gives a uniform layer of activator on the photographic product to be developed. It needs to be miscible in the alkaline activator, that is to say it needs to form a homogeneous solution with the other compounds present in the activator. It needs to be stable over time in a highly alkaline medium. Indeed the activator needs to be able to be stored without losing these properties of development or spreading. By way of example, these wetting agents can be anionic, cationic, non-ionic or amphoteric surfactants, alone or in a mixture. These surfactants are, for example, Zonyl FSN® and Alkanol XC® manufactured by Dupont, Lodyne S-100® manufactured by Ciba-Geigy and Olin 10G® manufactured by Olin Mathieson.

As FIGS. 3, 4, 5, 6 and 7 show, it is very important, in the scope of the present invention, to obtain a thin layer of activator that is uniform over the whole surface of the film to be processed. There must not appear, after the application of the activator, film parts not covered by this thin layer.

According to the method of the present invention, the activator contains quaternary ammonium salts. These quaternary salts are represented by the following formula:

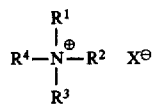

(I)

in which $R^1$, $R^2$, $R^3$ and $R^4$ are each independently selected from hydrogen, an alkyl group from 1 to 4 carbon atoms, an aromatic group which may contain one or more nitrogen atoms, and the groups $R^1$, $R^2$, or $R^1$, $R^2$, $R^3$ can also represent the atoms or bonds needed to form a ring, aromatic or otherwise, with 5 or 6 members.

X is the counter-ion that balances the charge of the molecule. X can, for example, be a halide or a sulfonate.

According to the invention, the quantity of quaternary ammonium salt is between 0.1 and 20 g/l preferably between 1 and 10 g/l.

These quaternary ammonium salts can, for example, be 1-phenethyl-2-methyl pyridinium bromide, 2-phenethyl-1-pyridinium bromide, 1-phenethyl-2-pyridinium bromide, 2,6-dichlorobenzyl-1-pyridinium bromide, benzyltriethylammonium chloride, tetrabutylammonium perchlorate, 1,4-dimethylpyridinium p-toluene sulfonate, 1-methyl-2-propynyl-2-pyrydinium bromide or tetrapropyl ammonium chloride.

According to a preferred embodiment, the quaternary ammonium salt is a salt of formula (I) in which at least one of the groups $R^1$, $R^2$ and $R^3$ is an aryl group. According to another preferred embodiment, the quaternary ammonium salt is a salt of formula (I) in which $R^1$, $R^2$ and $R^3$ represent the atoms required to form a pyridinium heterocyclic compound. According to one embodiment of the invention, the ammonium salt is 1-phenethyl-2-methylpyridinium.

The activator solution of the present invention can contain other compounds such as for example anti-fogging agents, preservatives, bactericides, fungicides, sequestering agents or buffer compounds. Examples of these compounds are described in *Research Disclosure*, September 1994, 365, No. 36544 (referred to hereinafter as *Research Disclosure*), Section XIX.

The photographic product useful in the present invention comprises a support covered on at least one of these faces with a layer of silver halide emulsion.

The silver halide emulsion consists of grains of silver halide in a hydrophilic binder, for example gelatin. The various methods of preparing these emulsions were described in *Research Disclosure*, section I-C. The gelatin can be replaced partially by other synthetic or natural hydrophilic colloids such as albumen, casein, zein, a polyvinyl alcohol or cellulose derivatives such as carboxymethylcellulose for example. Such colloids are described in Section II of *Research Disclosure*. The silver halide grains can have different morphologies (see Section I-B of *Research Disclosure*).

*Research Disclosure*, Section I-A describes the silver halide compositions of these grains. The silver halide grains can consist of chloride, bromide, chlorobromide, bromochloride, chloroiodide, bromoiodide or bromochloroiodide.

The silver halide grains can be chemically sensitized as described in *Research Disclosure*, Section IV.

The silver halide grains can be spectrally sensitized as described in *Research Disclosure*, Section V.

In addition to the compounds cited previously, the photographic product can contain other photographically useful compounds, for example coating aids, stabilizing agents, plasticizers, anti-fogging agents, tanning agents, antistatic agents, matting agents, etc. Examples of these compounds are described in *Research Disclosure*, Sections VI, VII, VIII, X.

The supports that can be used in photography are described in Section XV of *Research Disclosure*; Section XV. These supports are generally polymer supports such as cellulose, polystyrene, polyamide, polyvinyl, polyethylene or polyester polymers or paper or metal supports.

The photographic products can contain other layers, for example a protective top layer, intermediate layers, an antihalation layer, an antistatic layer, etc. These various layers and their arrangement are described in Section XI of *Research Disclosure*.

According to one embodiment, the photographic product comprises at least one intermediate layer between the support and the layer of emulsion, this intermediate layer adjacent to the layer of emulsion containing the developer.

The photographic products of the invention are preferably films for graphic arts. These films are high-contrast films. The emulsions used in this type of film are generally emulsions with chlorobromide cubic grains having a chloride content above 50 mol %, preferably around 70 mol %.

Photographic products for graphic arts are sensitized with dyes that sensitize the emulsion either to red or to blue.

Photographic products for graphic arts generally have a silver content of between 20 and 40 g/m$^2$, with a ratio by weight of Gelatine/Silver between 0.5 and 5, preferably 1 and 4.

EXAMPLES

The photographic product used in the following examples comprises an ESTAR® ethylene polyterephthalate support covered with an under-layer of gelatin (1.8 g/m$^2$) containing the developer (tert-butylhydroquinone TBHQ, 1.7 g/m$^2$), the co-developer (4-methyl-4-hydroxymethylphenidone, 0.1 g/m$^2$), and a hardening agent (bisvinylmethylsulfone, 3.5% by weight compared to the total dry gelatin). This under-layer is covered with a layer of silver halide emulsion, itself covered with a protective top layer of gelatin (0.8 g/m$^2$).

The silver halide emulsion consists of cubic grains (0.2 μm edge) of silver chlorobromide (70 mol % of chloride) doped with rhodium. The grains were chemically sensitized with sulfur ($2.98\times10^{18}$ atoms of sulfur/mol Ag) and with gold ($3.50\times10^{18}$ atoms of gold/mol Ag). They were spectrally sensitized in the blue region with a spectral sensitizer of formula (I) (maximum absorption 490 nm)

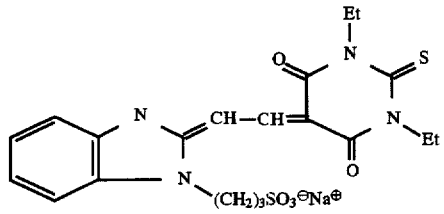

(I)

The silver content of the emulsion layer was 3.2 g/m$^2$, the gelatin content 2 g/m$^2$.

The photographic product described above was then exposed through a sensitometric wedge with 18 steps (increments of 0.1) with a xenon flash exposure meter for 2 microseconds through a colored filter approximately simulating the emission of a blue CRT (type p11). The product was then developed according to the methods described in the following examples, fixed and rinsed in a conventional manner.

After the film was processed, the following sensitometric parameters were determined:

Dmin (density of support+fogging)

Dmax (point of maximum density)

Effective contrast (EC) (slope of the sensitometric curve measured between a density of 0.1 and 2.5.

Contrast in the toe (TC) of the sensitometric curve (slope of the sensitometric curve measured between a density of 0.1 and 0.6)

Contrast in the top of the sensitometric curve (USC) (slope of the sensitometric curve measured between 2.5 and 4.0).

Example 1 (Comparative)

After exposure of the film described above, a quantity of around 20 ml/m$^2$ of an activator having the following composition was applied to the film.

| Composition of the activator | |
|---|---|
| $Na_2CO_3$ | 25 g/l |
| KBr | 10 g/l |
| $Na_2SO_3$ | 60 g/l |
| KOH | Quantity enabling pH to be adjusted to 12.5 (around 15 g) |
| Wetting agent OLIN 10 G ® | 0.6% of activator(by vol). |

The activator was applied by means of the device described in FIG. 1.

A thin layer of activator was thus formed which enables the film to be developed. In this embodiment, the activator remains in contact with the film for 20 seconds.

The device was then moved in the reverse direction to eliminate the activator in excess. The film was then placed in a stopping bath (30 seconds), a fixing bath (1 min, 25° C.) followed by a washing bath.

The sensitometric results are shown in Table 1 below.

Example 2 (Comparative)

After exposure of the film described previously, the method of Example 1 was repeated using an activator in which the potassium hydroxide and sodium carbonate were replaced with a quantity of alkanolamine (methyl-2-aminoethanol) giving a pH of 12.5.

| Composition of activator | |
|---|---|
| KBr | 10 g/l |
| $Na_2SO_3$ | 60 g/l |
| methyl-2-aminoethanol | 75 ml/1 (1 mol/l) |
| OLIN 10 G ® | 0.6% of activator (by vol). |

The sensitometric results are shown in Table 1 below.

Example 3 (Invention)

After exposure of the film as previously described, the method of Example 2 was repeated using an activator to which a quaternary ammonium salt, 1-phenethyl2-methyl pyridinium bromide (PMP) in a quantity between 0.5 and 6.5 g/l was added (examples 3(1) to 3(5) of Table 1).

| Composition of activator | |
|---|---|
| 2-methylaminoethanol | 75 ml/l (1 mol/l) |
| KBr | 10 g/l |
| $Na_2SO_3$ | 75 g/l |
| Wetting agent OLIN 10 G ® | 0.6% of activator (by vol). |
| 1-phenethyl-2-methyl pyridinium bromide | 0.5 to 6.5 g/l |

Figure 3:
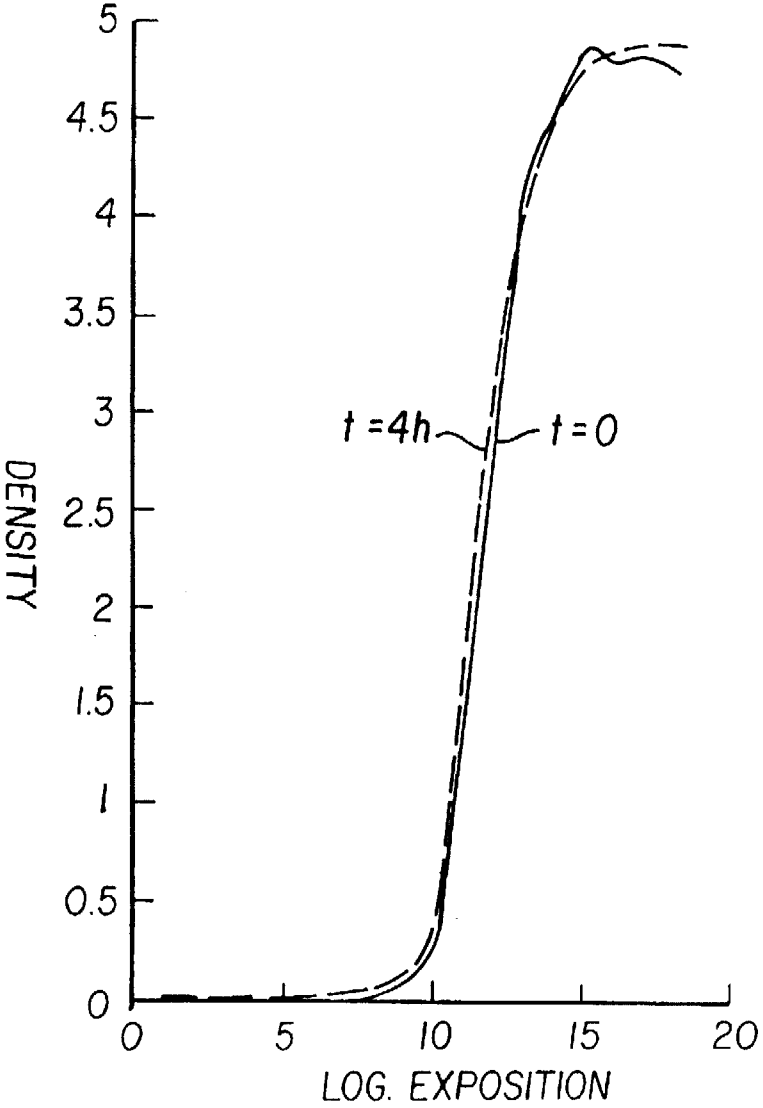
FIG. 3 is a sensitometric curve obtained with a photographic product developed according to the method of the present invention.

The sensitometric results are shown in Table 1 below. FIG. 3 depicts the sensitometric curve obtained with the above activator in surface application.

Example 4 (Control)

In this example, a photographic product was developed as described previously with a conventional manual processing device in a deep tank agitated by nitrogen bubbling (volume of tank 5 1) using the activator of Example 3 in which the quantity of 1-phenethyl-2-methyl pyridinium (PMP) was equal to 5 g/l.

The sensitometric results are shown in Table 1 below.

TABLE 1

| | (PMP) (g/l) | Dmin | Dmax | EC | USC | TC |
|---|---|---|---|---|---|---|
| Ex 1 | 0 | 0.027 | 1.902 | * | * | 2.48 |
| Ex 2 | 0 | 0.028 | 3.142 | 5.08 | ** | 3.57 |
| Ex 3(1) | 0.5 | 0.031 | 4.831 | 6.68 | 7.47 | 3.39 |
| Ex 3(2) | 1.5 | 0.029 | 5.143 | 7.28 | 9.75 | 3.54 |
| Ex 3(3) | 3 | 0.031 | 5.355 | 7.73 | 11.19 | 3.54 |
| Ex 3(4) | 5 | 0.031 | 5.223 | 8.18 | 10.69 | 3.69 |
| Ex 3(5) | 6.5 | 0.031 | 4.930 | 8.26 | 9.91 | 3.76 |
| Ex 4 | 5 | 0.052 | 5.285 | 7.22 | 8.44 | 3.68 |

*not measurable
**not available

These examples show that the presence of the alkanolamine and of the quaternary ammonium salt leads to a strong increase in the Dmax, and in the various contrasts, with Dmin remaining unchanged.

Example 4 shows that, when the same activator is used with a conventional developing device, inferior sensitometric results are obtained. The activator of the present invention, when it is used for surface application, therefore produces surprising results.

Example 5

In this example, a photographic product as described previously was used in which the incorporated developer was a mixture of tert-butylhydroquinone (TBHQ) and hydroquinone (molar ratio 1/1).

The method of Example 1 was repeated using an activator having the following composition in which several quaternary ammonium salts have been tested.

| Composition of activator | |
|---|---|
| 2-methylaminoethanol | 75 ml/l (1 mol/l) |
| KBr | 10 g/l |
| $Na_2SO_3$ | 75 g/l |
| OLIN 10 G ® | 0.6% of activator by vol |
| quaternary ammonium salt | 5 g/l |

TABLE 2

| Quaternary ammonium | Dmin | Dmax | EC | TC |
|---|---|---|---|---|
| Control - without quaternary ammonium | 0.023 | 4.342 | 6.04 | 3.42 |
| 1-phenethyl-2-pyridinium bromide | 0.023 | 5.28 | 10.85 | 4.72 |
| 2-phenethyl-1-pyridinium bromide | 0.024 | 5.249 | 10.69 | 4.75 |
| 2,6-dichlorobenzyl-1-pyridinium bromide | 0.023 | 5.11 | 9.12 | 4.414 |
| benzyltriethylammonium chloride | 0.023 | 4.899 | 7.87 | 3.98 |
| tetrabutylammonium perchlorate | 0.026 | 4.525 | 7.00 | 3.80 |
| 1,4-dimethylpyridinium p-toluene sulfonate | 0.024 | 4.813 | 6.89 | 3.53 |
| tetrapropyl ammonium chloride | 0.027 | 4.517 | 6.77 | 3.68 |

As in the previous examples illustrating the present invention, the activator of the invention applied on the surface produces an increase in the Dmax and contrast, the Dmin being unchanged. Furthermore, these examples show that the use of pyridinium salts leads to still further improvement in the sensitometric results.

Example 6

In this example, the film with an incorporated developer used previously in Example 1 was used, except that it contains tert-butylhydroquinone (TBHQ) as the developer.

The exposed film was developed according to the method of Example 1 with an activator with the following composition.

| Composition of Activator | |
|---|---|
| 2-methylaminoethanol | 75 ml/l (1 mol/l) |
| KBr | 5 g/l |
| $Na_2SO_3$ | 75 g/l |
| 5-nitroindazole | 0.1 g/l |
| Wetting agent | 0.6% of activator (by vol) |
| 1-phenethyl-2-methyl-pyridinium bromide | 5 g/l |

The various surfactants defined above were tested. FIGS. 4, 5, 6 and 7 are the comparative sensitometric curves obtained with wetting agents not able to be used during a development by surface application of an exposed photographic product.

The sensitometric results are shown in Table 3.

TABLE 3

| Wetting agents | Time | Dmax | EC | USC | TC |
|---|---|---|---|---|---|
| Zonyl FSN ® (non-ionic) | T = 0 | 4.843 | 6.79 | 22.59 | 4.1 |
| | T – 4 H | 4.815 | 8.8 | 10.14 | 3.83 |

TABLE 3-continued

Figure 4:
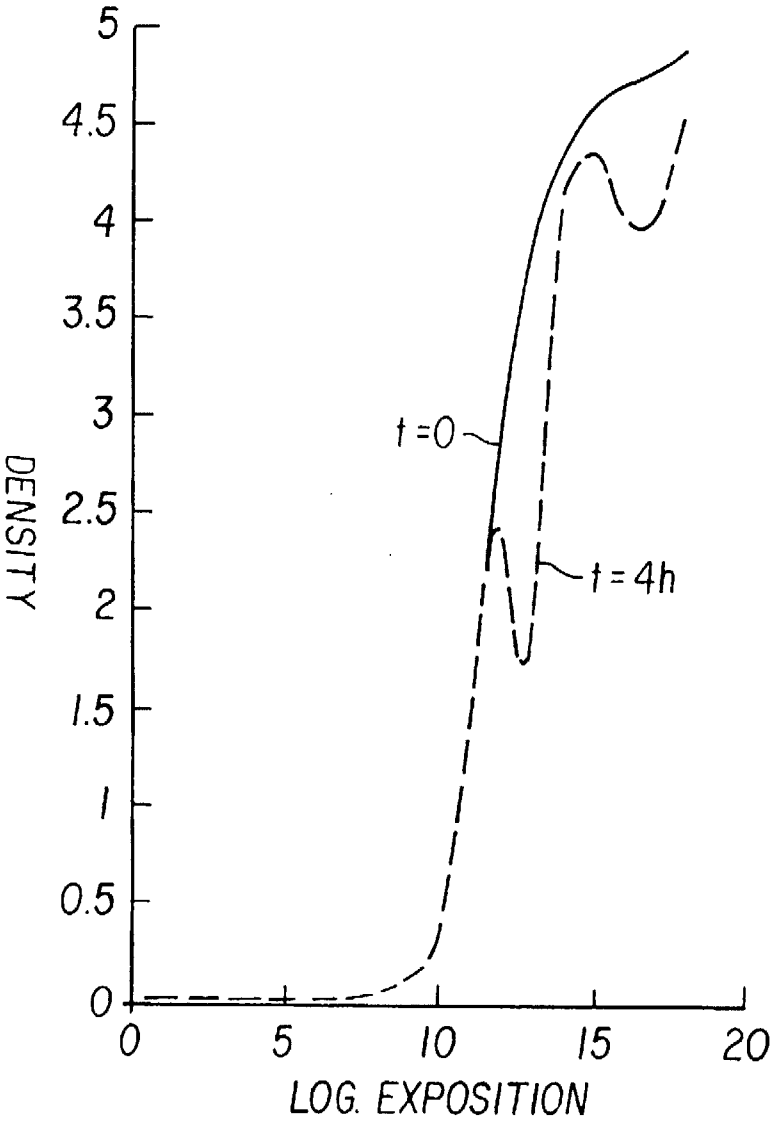
FIGS. 4, 5, 6 and 7 are comparative sensitometric curves.
Figure 6:
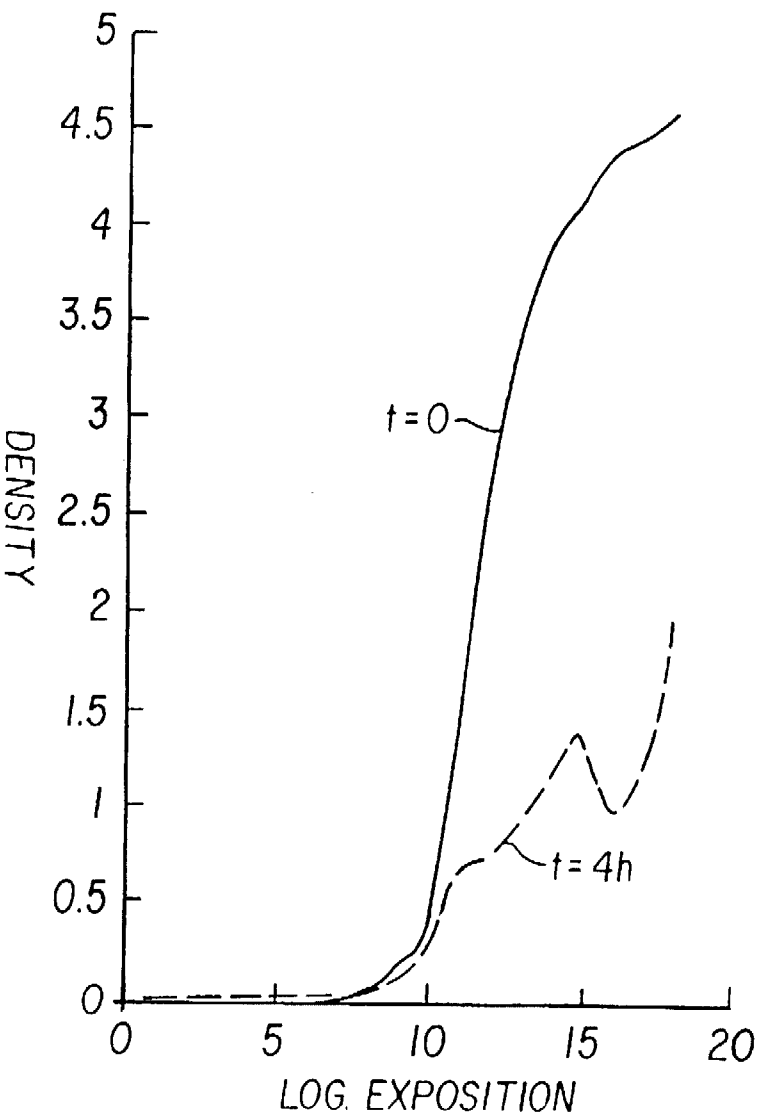
Figure 5:
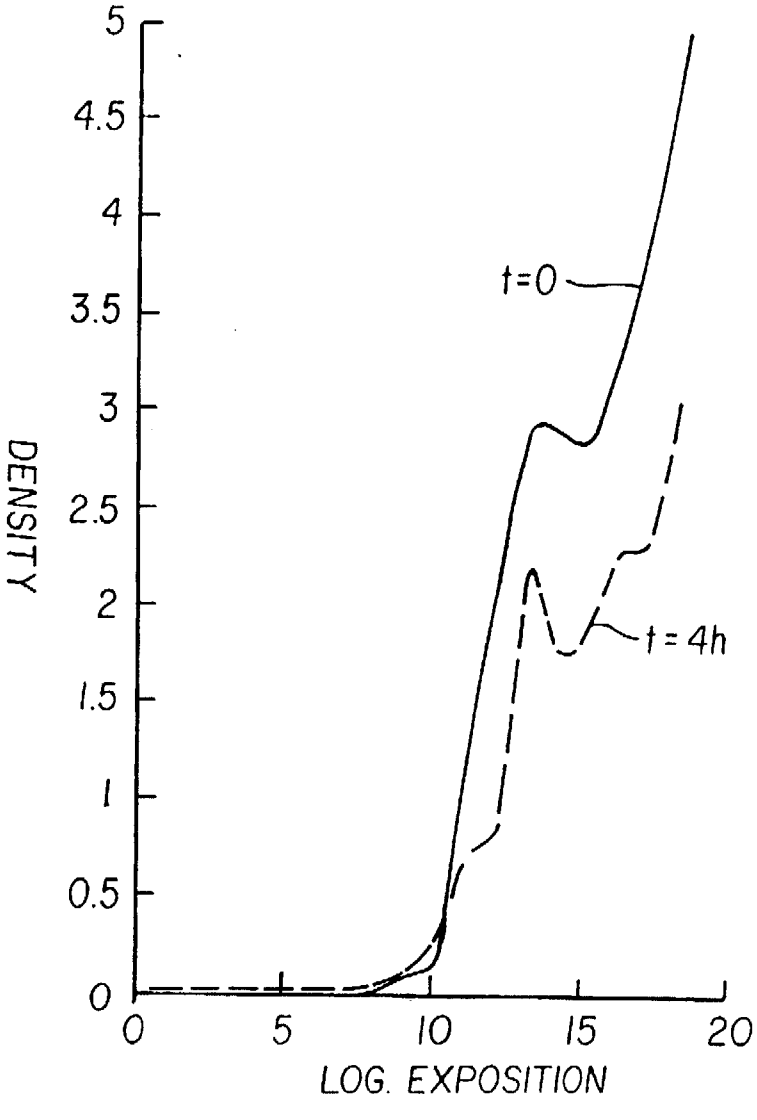
Figure 7:
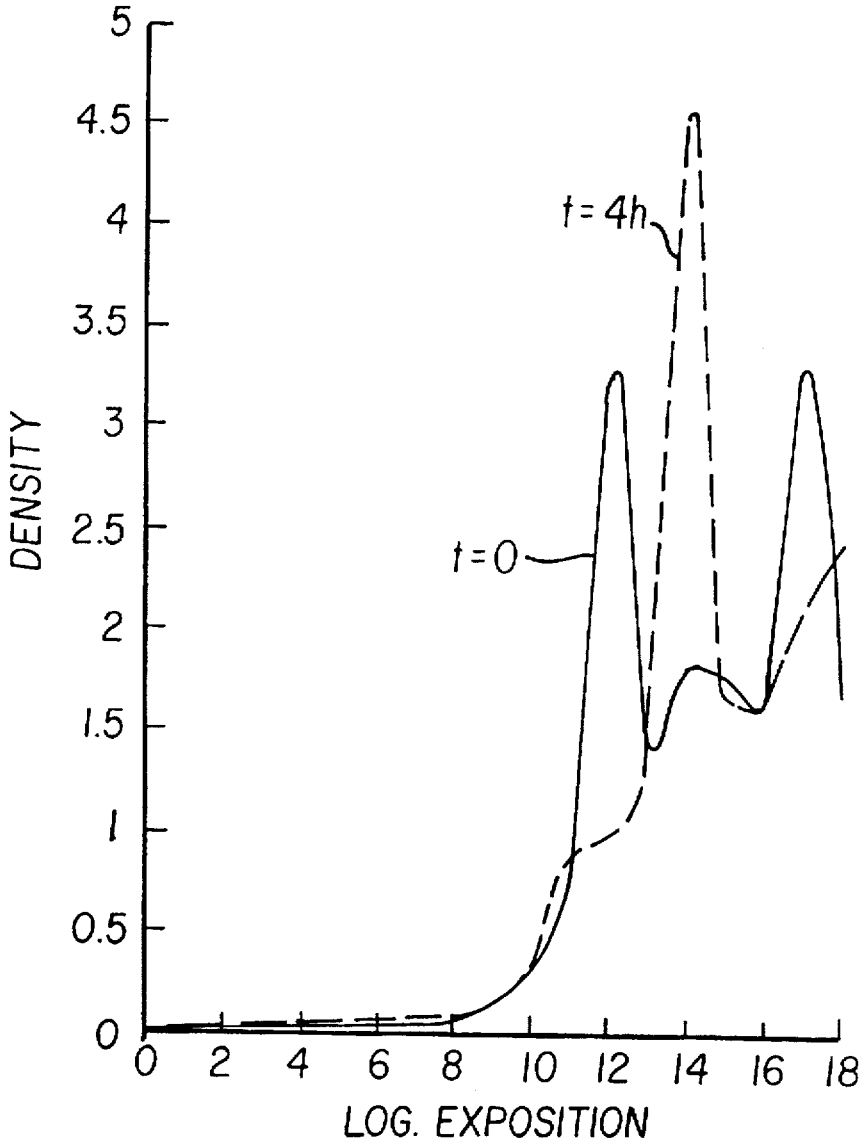

| Wetting agents | Time | Dmax | EC | USC | TC |
|---|---|---|---|---|---|
| Alkanol XC ® (anionic) | T = 0 | 4.691 | 8.47 | 6.93 | 4.14 |
| | T = 4 H | 4.676 | 8.66 | 6.51 | 4.22 |
| Duponol ® dodecyl sulfate (anionic) | T = 0 | | See FIG. 4 | | |
| | T = 4 H | | | | |
| Saponin ® (anion./non-anionic) | T = 0 | | See FIG. 5 | | |
| | T = 4 H | | | | |
| Siloxane and silicone (non-ionic) | T = 0 | | See FIG. 6 | | |
| | T = 4 H | | | | |
| Lodyne S-100 (amphoteric) | T = 0 | 4.835 | 9.28 | 9.66 | 4.07 |
| | T = 4 H | 4.666 | 9..07 | 8.73 | 4.2 |
| Fluorad ®, 3M | T = 0 | 4.891 | 9.37 | 10.24 | 3.94 |
| | T = 4 H | 4.717 | 8.91 | 8.24 | 3.97 |
| No surfactant control | T = 0 | | See FIG. 7 | | |
| | T = 4 H | | | | |

The above examples were produced with a freshly prepared activator, and 4 hours after the preparation of this same activator.

These examples show that the choice of the wetting agent is important if the activator of the invention is to be used for surface application. The wetting agent will be chosen so as to form with the other components of the activator a solution that is homogenous and stable over time.

Example 7

An activator was produced as described in Example 3, in which the wetting agent was replaced with a thickening agent (hydroxyethylcellulose, 0.5% by weight of activator). When such an activator was used for surface application, the development kinetics were significantly slowed, and the Dmax figures were very much lower than those obtained with the activator of the present invention. In the case of treatment by surface application, the use of a thickening agent does not give an acceptable development of the exposed photographic product.

The invention has been described in detail with particular reference to certain preferred embodiments thereof, but it will be understood that variations and modifications can be effected within the spirit and scope of the invention.

I claim:

1. An aqueous development activator solution comprising an alkanolamine in an amount higher or equal to 0.6 mol/l, 0.1 to 3% by volume of at least one anionic, nonionic or amphoteric wetting agent that is miscible in the activator solution and has a high pH stability, and from 1 to 20 g/l of a quaternary ammonium salt.

2. The activator solution of claim 1 wherein said quaternary ammonium salt corresponds to the following formula:

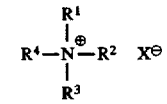

(I)

in which $R^1$, $R^2$, $R^3$ and $R^4$ are each independently selected from hydrogen, an alkyl group from 1 to 4 carbon atoms, an aromatic group which may contain one or more nitrogen atoms, and the groups $R^1$, $R^2$, or $R^1$, $R^2$, $R^3$ can also represent the atoms or bonds needed to form an aromatic or non-aromatic ring with 5 or 6 members, X is a counter-ion that balances the charge of the molecule.

3. The activator solution of claim 1 wherein said quaternary ammonium salt is a pyridinium salt present in a quantity between 1 and 10 g/l.

4. The activator solution of claim 3 wherein said pyridinium salt is the salt of phenethyl-1-methyl-2-pyridinium.

5. The activator solution of claim 1 wherein said alkanolamine is monoethanolamine, diethanolamine or 2-alkylethanolamines.

6. The activator solution of claim 5 wherein said alkanolamine is 2-methylethanolamine.

7. The activator solution of claim 2 wherein said quaternary ammonium salt is a salt of formula (I) in which $R^1$, $R^2$ and $R^3$ represent the atoms required to form a pyridinium heterocyclic compound.

8. The activator solution of claim 2 wherein said quaternary ammonium salt is a salt of formula (I) in which at least one of the groups $R^1$, $R^2$ and $R^3$ is an aryl group.

9. The activator solution of claim 1 wherein said alkanolamine is present in an amount from 0.8 to 1.5 mol/l.

10. A method for developing an exposed photographic product comprising a layer of incorporated developer, said photographic product also comprising a thin activator layer applied as the aqueous activator solution of claim 1.

11. The method of claim 10 wherein said layer containing said incorporated developer is situated between a support and a silver halide emulsion layer.

12. The method of claim 11 wherein said silver halide emulsion is an emulsion comprising mostly silver chloride.

13. The method of claim 10 wherein said incorporated developer is hydroquinone or a hydroquinone derivative.

14. The method of claim 10 wherein the quantity of said activator in said product is between 20 ml/$m^2$ and 200 ml/$m^2$ of photographic product to be developed.

* * * * *